United States Patent [19]

Knickerbocker

[11] 4,037,701

[45] July 26, 1977

[54] PRICE SETTER FOR TOTALIZER COIN MECHANISM

[76] Inventor: Karl Knickerbocker, 400 Baycrest Drive, Venice, Fla. 33595

[21] Appl. No.: 696,129

[22] Filed: June 14, 1976

Related U.S. Application Data

[63] Continuation-in-part of Ser. No. 616,944, Sept. 26, 1975, abandoned.

[51] Int. Cl.[2] ..... G07F 5/08

[52] U.S. Cl. ..... 194/1 L

[58] Field of Search ..... 194/1 L, 51, 59, DIG. 3, 194/94

[56] References Cited

U.S. PATENT DOCUMENTS

| | | | |
|---|---|---|---|
| 3,882,984 | 5/1975 | Knickerbocker | 194/94 |
| 4,000,799 | 1/1977 | Knickerbocker | 194/1 L |

*Primary Examiner*—Stanley H. Tollberg
*Attorney, Agent, or Firm*—Arthur W. Fisher, III

[57] ABSTRACT

A coin controlled mechanism for use with a dispensing device having an access door including a locking assembly operatively controlled by the coin controlled mechanism wherein the coin controlled mechanism comprises a housing configured to operatively support an actuator to control the opening of the door and a totalizer to calculate the cumulative total of coins registered by the coin controlled mechanism. A coin chute comprising a plurality of coin passages is formed in a single plane and controls the direction of coins with respect to the particular denomination thereof. An actuator control assembly is provided to control the incremental advance of the totalizer. The totalizer and coin chute are arranged relative to one another such that coins passing through the coin chute to engage and incrementally advance the totalizer in response to coins whereby the locking assembly is released upon totalizing or calculating a predetermined price total. The coin controlled mechanism further includes an adjustable price setter to vary the predetermined price total.

6 Claims, 15 Drawing Figures

FIG. 6
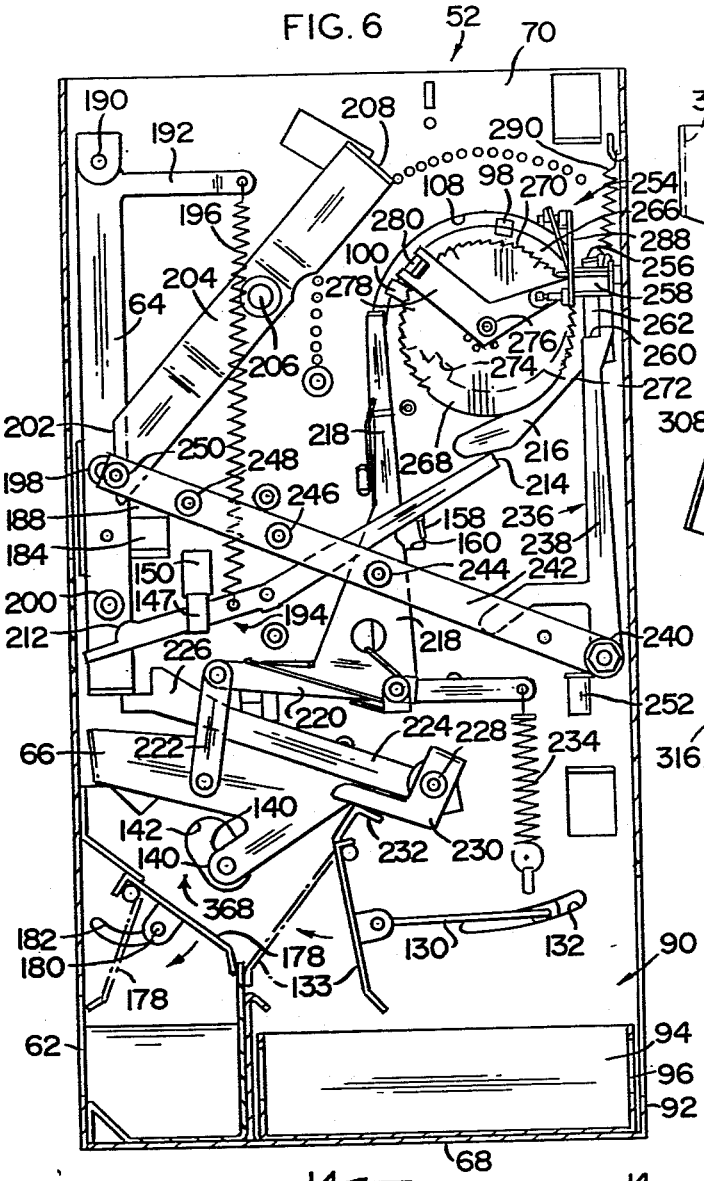
FIG. 11
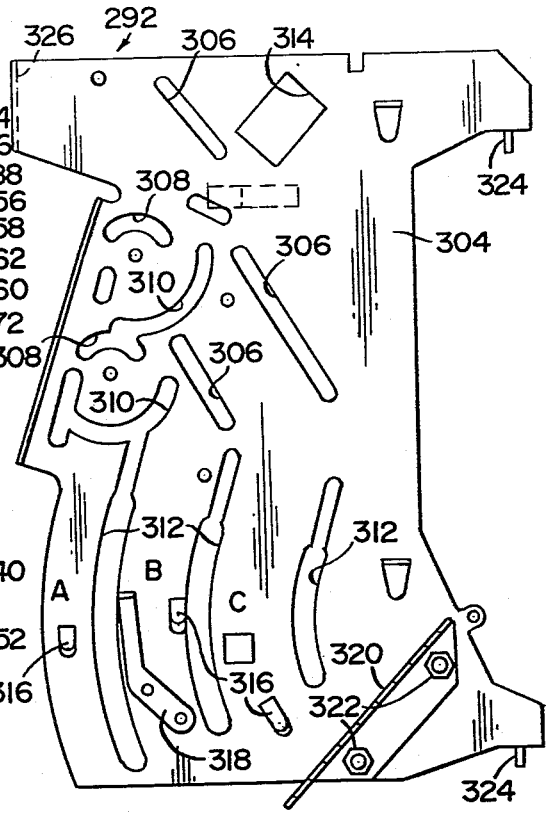
FIG. 12
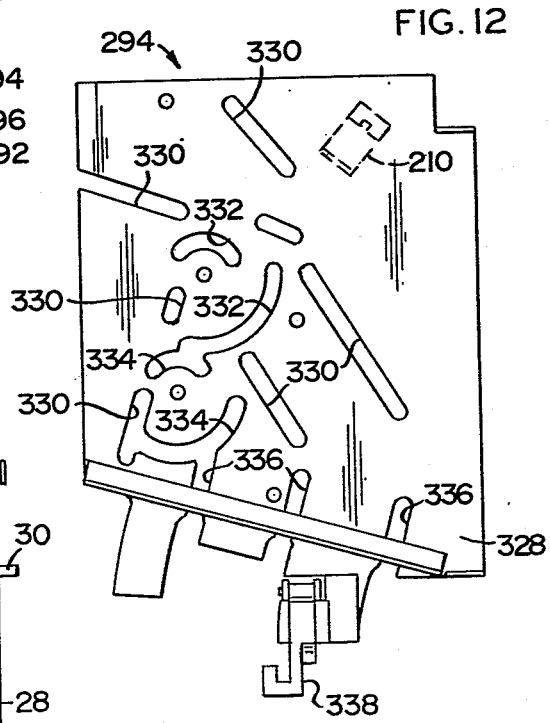
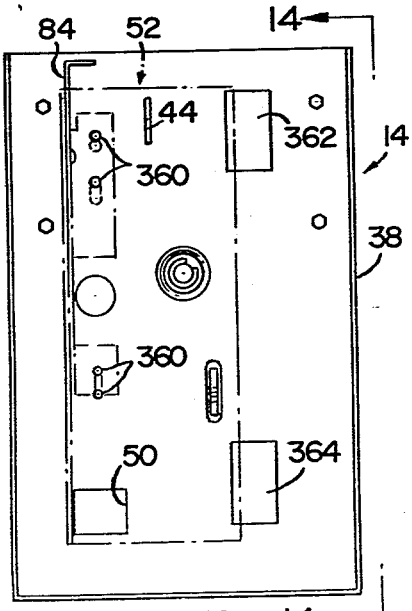
FIG. 13
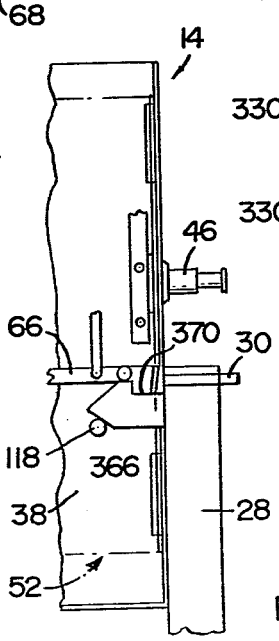
FIG. 14

PRICE SETTER FOR TOTALIZER COIN MECHANISM

This is a continuation-in-part application of copending application Ser. No. 616,944 filed Sept. 26, 1975 now abandoned.

BACKGROUND OF THE INVENTION

1. Field of the Invention

A coin controlled mechanism for use in combination with a dispensing device wherein the coil controlled mechanism includes a totalizer means to calculate the cumulative value of coins inserted therein to control the dispensing device.

2. Description of the Prior Art

A great many newspaper racks, cigarette machines and the like have been developed to provide a means of vending such items without the necessity of an attendant.

Today, most such machines include a mechanism for controlling the door or other dispensing element to permit opening the door only after the proper number of coins of proper denomination have been deposited in the machine. These machines may be mechanical, electro-mechanical or electrical.

It is obvious that the utilization of an efficient, accurate and reliable coin totalizer mechanism is crucial in the success and growth of the vending machine industry. Generally, these coin mechanisms are mechanical, electrical or a combination of electro-mechanical in their mode of operation.

An increasing number of electrically actuated coin controlled vending machines are becoming available. Basically, these machines may be considered somewhat more "sophisticated" in that they are designed to vend or dispense a plurality of different kinds of brands of merchandise within a varying price range. In this type of application, electrically operated vending machines are considered to have certain advantages over mechanical vending machines. These advantages generally relate to the factor of reliability wherein it may be considered that mechanical vending machines are more susceptible to abuse due to slamming, shaking or general rough treatment. This type of abusive treatment frequently results in mechanical failure of the mechanically operated vending machine because of the disruption of the linkage or gearing, etc. found therein.

Unfortunately, electrical vending machines generally comprise complicated electrical circuits and electrical parts making for increased liability to failure due to short circuits or other electrical faults. In addition, in many uses electrical power is not readily available for use with these vending machines.

Until recently, it is also considered that mechanical vending machines did not have the versatility to accept a wide variety of coins of various denomination in order to accomplish efficient dispensing of a product at one or more preselected prices. Accordingly, mechanical vending machines and more specifically, the coin totalizer mechanisms essentially controlling the dispensing of the product have been designed to handle a wide variety of coins deposited therein in any given sequence such that the mechanism will activate dispensing upon reaching or totalizing a predetermined quantity of money being deposited. In order to accomplish this versatility the design and structure of prior art coin totalizer mechanisms have become relatively complex thereby leading to increased rates of breakdown, less reliability and a greater expense for initial purchase and maintenance.

Thus, a need exists for a reliable mechanically operated coin controlled dispensing mechanism having the capability of registering relatively large amount of change to control the dispensing cycle in response thereto. Further there is a need for a means of easily adjusting the amount of change to properly actuate the dispensing mechanism.

SUMMARY OF THE INVENTION

The present invention relates to a coin controlled mechanism for use in combination with a dispensing device having an access door including locking means operatively controlled by the coin controlled mechanism. More specifically, the coin controlled mechanism of the present invention comprises a totalizer means and a coin chute means arranged relative to one another such that as coins pass through the coin chute means they engage the totalizer means to advance the totalizer means in response to the characteristics of the coins of different denomination. The locking means of the dispensing device is thereby released upon the registering of a predetermined price total.

The totalizer means includes a totalizer operator and register means to calculate the cumulative value of coins inserted into the mechanism. A latch control means is provided to control movement of the access door and an adjustable price setter means is used to set the price or value necessary to operate the mechanism at a predetermined price setting. A totalizer control means is disposed to control movement of the totalizer operator and register means. Further a totalizer locking means is incorporated to prevent inadvertent actuation of the totalizer means. A totalizer release and reset means is used to release the totalizer control means and reset the latch control means respectively.

The coin chute means includes an actuator control means to control the incremental advance of the totalizer means in response to coins passing therethrough. The coin chute means includes a plurality of plates arranged in spaced parallel relationship relative to one another and includes a plurality of coin guides and switches cooperatively formed in a plurality of coin passages to control the passage of coins therethrough.

The adjustable price setter means comprises an adjustable limit means to permit a rapid changing of a price selected between an upper and lower limit. This is particularly useful in the case of the newspaper or similar article vending machines wherein the price may vary from the daily to the Sunday paper.

In addition, the coin controlled mechanism includes a coin return means to permit return of the coins when the latch controlled mechanism further includes an anti-cheat means which prevents the simultaneous actuation of the coin return means and the latch control means.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 6 is a right side view of the coin controlled mechanism with the coin chute means removed.

FIG. 11 is a right side view of the first coin chute plate.

FIG. 12 is a right side view of the second coin chute plate.

FIG. 13 is a rear view of the coin housing and coin controlled mechanism taken along line 13—13 of FIG. 5.

FIG. 14 is a left side view of the coin housing and coin controlled mechanism taken along line 14—14 of FIG. 1.

FIG. 15 ia a partial top view of the adjustable price setter.

Similar reference characters refer to similar parts throughout the several view of the drawings.

DETAILED DESCRIPTION OF THE PREFERRED EMBODIMENT

Figure 1:
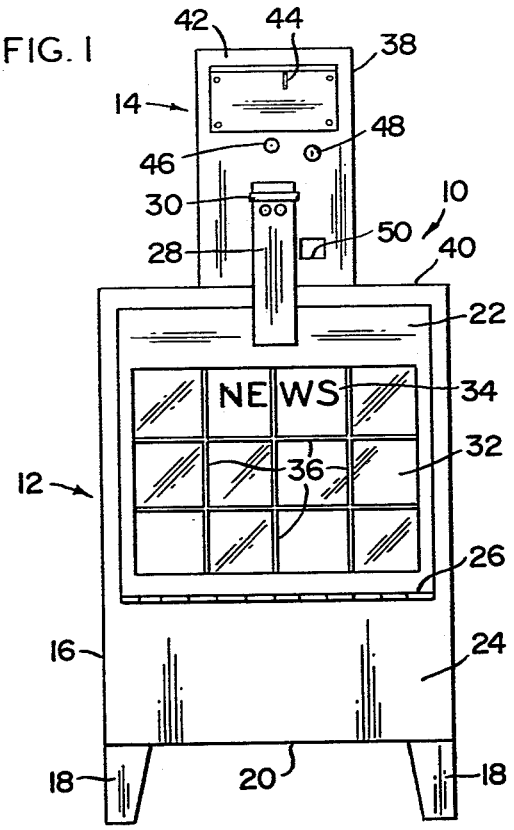
FIG. 1 is a front view of a dispensing device incorporating the coin controlled mechanism of the present invention.

FIG. 1 shows a coin controlled mechanism in combination with a periodical dispensing device generally indicated as 10. Periodical dispensing device 10 comprises periodical housing 12 and coin controlled mechanism housing 14 fixedly mounted thereon. Periodical housing 12 comprises a substantially rectangular enclosure 16 supported by a plurality of support members 18 attached to the base 20 thereof. Access door 22 is pivotally attached to the front 24 of enclosure 16 for loading and dispensing a periodical therethrough by hinge means 26. Access door 22 further includes access door extension 28 including access door extension handle 30. Access door window 32 comprises a transparent material to permit display of a periodical 34 held by retainer means 36. Coin controlled mechanism housing 14 comprises a substantially rectangular enclosure 38 attached to the top 40 of enclosure 16. Formed in the front 42 of enclosure 38 are coin insert slot 44, coin return actuator 46, price setter control means 48 and coin return receiver 50.

It is important to note that while the preferred embodiment of the present invention is described with specific reference to a periodical vending machine, the subject coin controlled mechanism is not limited to such machines and can be used for coin operated vending machines of various designs.

As described more fully hereinafter, the coin controlled mechanism of the present invention comprises an actuator means and a totalizer means to calculate the cumulative value of coins inserted into the mechanism, latch control means to control movement of the access door, adjustable price setter means to set the price of value necessary to operate the mechanism to a predetermined setting, totalizer control means to control the movement of the totalizer means, totalizer release and reset means to release the totalizer control means and reset the latch control means, and coin chute means including actuator control means to control the incremental advance of the totalizer means in response to coins passing there through.

Figure 2:
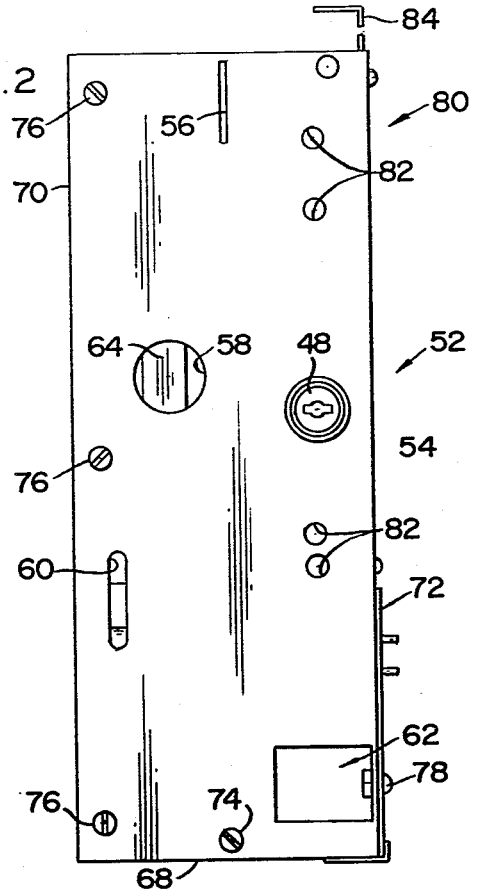
FIG. 2 is a front view of the coin controlled mechanism.

FIG. 2 is a front view of coin controlled mechanism generally indicated as 52. As shown, coin controlled mechanism 52 includes mechanism base plate 54 having base plate coin insert slot 56, coin return actuator opening 58, latch means opening 60 and coin return opening 62. Base plate coin insert slot 56 and coin return opening 62 are disposed to register with coin insert slot 44 and coin return receiver 50 respectively. Coin return actuator bar 64 is visible through coin return actuator opening 58 while catch member 66 is visible through latch means opening 60. Bottom plate 68, coin mechanism mounting plate 70 and partial side plate 72 respectively, are secured to base plate 54 by fastening means 74, fastening means 76 and fastening means 78 respectively. Attachment means 80 comprises apertures 82 and element 84 to secure coin controlled mechanism 52 within coin controlled mechanism housing 14 as more fully described hereinafter.

Figure 3:
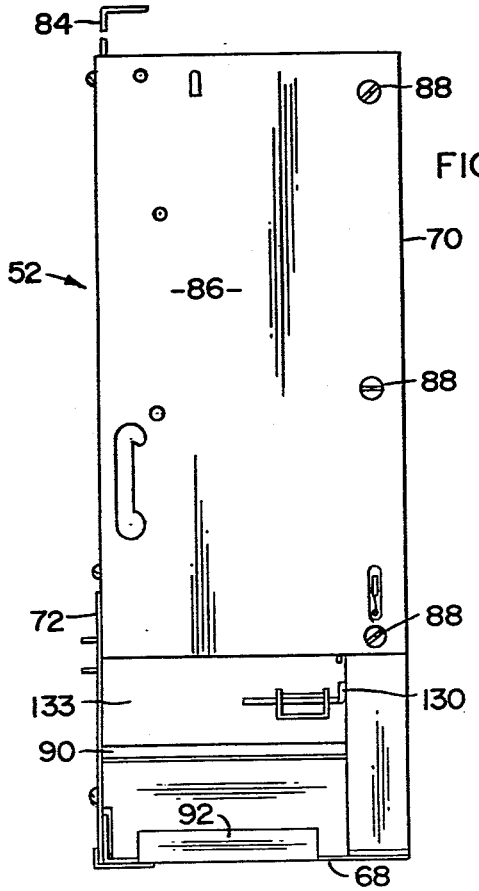
FIG. 3 is a rear view of the coin controlled mechanism.

FIG. 3 is a rear view of coin controlled mechanism 52. Back plate 86 is secured to coin mechanism mounting plate 70 by fastening means 88. Coin receptacle access opening 90 is cooperatively formed between the lower edge of back plate 86 and retainer means 92 comprising a lip or ridge extending upward from bottom plate 68. Coin receptacle 94 comprising an open receptacle is removably disposed within coin controlled mechanism housing 52.

Figure 4:
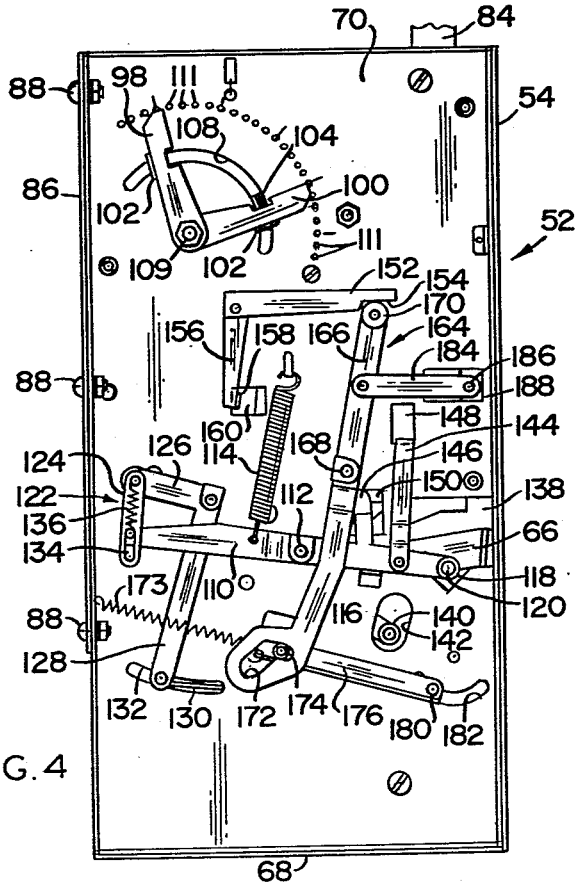
FIG. 4 is a left side view of the coin controlled mechanism.

FIG. 4 is a side view of coin controlled mechanism 52 showing coin mechanism mounting plate 70. The adjustable price setter means includes adjustment means comprising upper and lower adjustable limit means 98 and 100 respectively. Each of these members 98 and 100 include arm elements movably and pivotally mounted on stud or pin 109 which is attached to mounting plate 70. The opposite extremity of each arm includes a pin element disposed and configured to fit within any of the various apertures 111. In addition each of the arms are spring biased for engagement of the pin within the aperture 111. Manual placement of the upper extremity of each arm 98 and/or 100 in a predetermined aperture 111 determines the price setting of the mechanism. As shown in FIG. 6, adjustable limit means 98 and 100 each comprise a tab 102 including stop notch 104 formed thereon.

The actuator means can be best understood with reference to FIG. 4 and 6. As shown in FIG. 4, the actuator means includes element 110 pivotally mounted to plate 70 by stud 112. Bias spring 114 normally biases element 110 in the clockwise position. Tab stop 116 limits the clockwise movement of element 110 by engaging the lower surface thereof. Roller cam 118 is attached to one end of element 110 by stud 120 while coin receptacle door actuator means 122 is attached to the opposite end thereof. Coin receptacle door actuator means 122 comprises interconnecting linkages 124, 126 and 128 pivotally coupled to each other. Linkage 128 is interconnected to coin receptacle door 133 by shaft 130 which extends through slot 132. Linkage 124 includes elongated aperture 134 and is normally biased by bias means 136 as shown, to close the coin receptacle door 133 to the first portion (FIG. 6). Also shown are latch means 66 extending through aperture 138 and latch roller cam 140 extending through aperture 142. Also attached to actuator element 110 are dispensing release arm 144 and dispensing reset arm 146 extending inwardly through apertures 148 and 150 respectively.

Also shown in FIGS. 4 and 6 are coin return actuator means, return release means and return reset means. Return reset means includes substantially horizontal element 152 (FIG. 4) including camming surface 154 and substantially vertical element 156 attached thereto and including reset tab 158 pivotally mounted on plate 70. Reset tab 158 extends through reset aperture 160 to engage the reset mechanism as more fully described hereinafter. The coin return mechanism includes coin return actuator means generally indicated as 164. Coin return actuator 164 comprises actuator arm 166 pivotally attached to plate 70 by stud 168 having return reset roller cam 170 attached to the upper end thereof to operatively engage camming surface 145 and V-shaped camming surface 172 formed on the lower end thereof to engage coin return roller cam 174. Roller cam 174 is attached to coin return door actuator linkage 176 which is attached to coin return door 178 (FIG. 6) by coin return door arm 180 extending through coin return actuator slot 182. Coin return door actuator linkage 176 is normally biased toward rear plate 86 by spring bias means 173. Actuator arm 166 is interconnected to coin return actuator bar 64 by actuator linkage 184 and connecting rod 186 extending through aperture 188.

Figure 8:
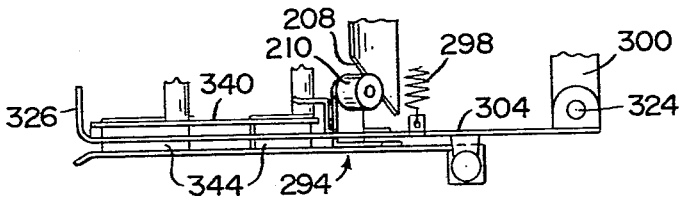
FIG. 8 is a top view of the coin chute means in the normal position.

FIG. 6 shows a detailed side view of coin controlled mechanism 52 with the coin chute means removed. As shown therein, coin return actuator bar 64 is pivotally attached to coin mechanism mounting plate 70 by stud 190. Extending outwardly is substantially horizontal element 192 interconnected to totalizer release link 194 by spring bias means 196. Attached to the lower portion of coin return actuator bar 64 are coin chute roller cam and coin release link roller cam 198 and 200 respectively. Coin chute roller cam 198 is in operative communication with the lower camming surface 202 of chute separator arm 204 pivotally attached to plate 70 by stud 206. Extending inwardly from the upper portion of arm 204 is camming surface 208 which is disposed to engage roller cam 210 as best shown in FIG. 8. One end of release link 194 includes camming surface 212 which is disposed to operatively engage roller cam 200 during the coin return cycle. The opposite end of release link 194 includes release tab 214 which is disposed to engage release actuator 216. Extending through aperture 148 is dispensing release tab 147 extending inwardly from member 144 as shown in FIG. 6. Extending through aperture 150 is dispensing reset tab 149. Latch means 66 is interconnected to dispenser actuator 218 by interconnecting links 220 and 222. The mechanism further includes anti-cheat means comprising anti-cheat stop 224 including notch portion 226 formed on the outer end thereof and pivotally attached to plate 70 by stud 228 attached to the opposite end thereof. Also mounted on stud 228 is camming member 230 which is disposed to operatively engage the coin receptacle door extension 232 during the periodically dispensing cycle. Dispenser actuator 218 is biased clockwise by bias spring means 234.

Totalizer means comprises totalizer control means 236 including member 238 pivotally attached to plate 70 by stud 240. Extending outwardly from actuator bar 242 is a plurality of parallel spaced actuator studs 244, 246, 248 and 250. Counter balance weight 252 is attached to stud 240 immediately below member 238. Extending upwardly from stud 240 is ratchet pawl means 254 including substantially vertically disposed member 256 and horizontal counter weight means 258. Ratchet pawl means 254 includes ratchet advance means or tab 260. Pivotally attached to plate 70 is totalizer locking means 262 including locking element 264 operatively coupled to release element 216.

Totalizer means further includes totalizer register means 268 including a plurality of teeth 270 formed about the periphery thereof. As discussed more fully hereinafter, each tooth represents a nickel value. Disposed substantially parallel to the totalizer register means in the form of ratchet wheel 268 is totalizer operator means 272 including enabling means or cutout portion 274, each plate being pivotally mounted on plate 70 by stud 276. Wheels 268 and 272 coupled by pin 273 are biased clockwise by bias means 275 coupled between stud 276 and wheel 268.

Figure 5:
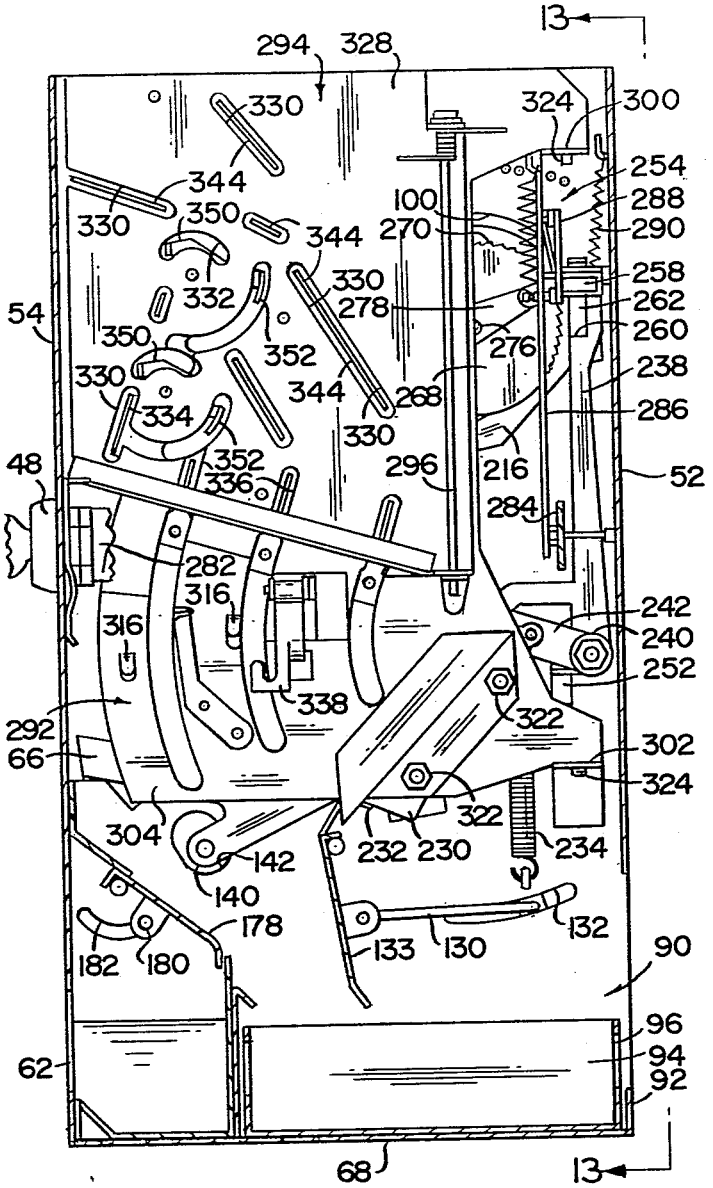
FIG. 5 is a right side view of the coin controlled mechanism.

As shown in FIGS. 5, 6 and 15 the adjustable price setter means includes substantially U-shaped mounting member 278 including limit stop 280 extending through price setting slot 108 to alternately engage limit means or stop 98 or 100 as described more fully hereinafter. Mounting member 278 operatively engages the totalizer register means 268 and totalizer operator means 272 to change the origin of rotation by movement of the mounting member 278 as more fully described hereinafter. Specifically limit tab 279 is formed on mounting member 278 to engage limit plate 281 formed on totalizer operator means 272. Since wheels 268 and 272 are biased in the clockwise direction and free to rotate on stud 276, limit plate 281 will follow limit tab 279 to control the movement of the wheels 268 and 272 by rotation of mounting member 278. Quick change actuator means includes interconnecting linkages 282, 284, 286 and 288 which interconnect mounting member 278 to price setter control means 48. Linkage 282 is a substantially horizontal element fixedly attached to price setter control means 48 to rotate therewith. Linkage 284 is a substantially vertical element attached between linkage 282 and 286 comprising a substantially horizontal element pivotally mounted on back plate 86. The opposite end of linkage 286 is coupled to mounting member 278 by substantially vertical linkage or element 288. Thus when control means 48 is moved from the first to second position, linkage 282 is rotated forcing linkage 284 upward rotating one end of linkage 286 upward rotating the opposite end downward forcing totalizer register means 268 and totalizer operator means 272 to rotate to the second or upper limit to change the origin of rotation. Price setter means 266 is normally biased in the first or lower position by spring bias means 290.

FIG. 5 is a detailed side view of coin controlled mechanism 52 showing the interior thereof. As shown therein, coin mechanism 52 includes first and second coin chute plates 292 and 294 interconnected by shaft 296. First and second chute plates 292 and 294 are normally biased to spaced parallel relation relative to each other by bias means 298 as shown in FIG. 8. The coin chute structure is mounted on plate 70 by mounting members 300 and 302.

As best shown in FIG. 11, first coin chute plate 292 comprises a substantially flat element 304, a plurality of coin guide apertures 306 and upper and lower slots 308 and 310 respectively, actuator arm slots 312 and coin return roller cam aperture 314. A plurality of coin guide tabs 316 extend outwardly from element 304. Nickel or first control element 318 is pivotally mounted on the lower portion of element 304. Coin deflector 320 is secured to element 304 by fastening means 322. First and second coin chute plates 292 and 294 respectively are pivotally attached to the base plate 70 by mounting pins 324. The forward portion of element 304 includes spacer means 326 which cooperates with bias means 298 to hold plates 292 and 294 in substantially horizontal spaced relation to each other. The lower end of slots form quarter or third control element.

As best shown in FIG. 12, second coin chute plate 294 comprises a second substantially flat element 328. A second plurality of coin guide apertures 330, upper and lower cradle slots 332 and 334 respectively, and actuator arm slots 336 corresponding to those of first coin chute plate 292. Dime or second control element 338 is pivotally mounted on the lower portion of element 328. A phantom of roller cam 210 is also shown.

Figure 9:
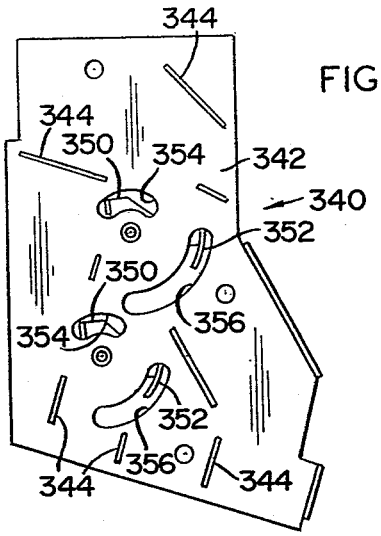
FIG. 9 is a right side view of the coin chute means mounting plate.
Figure 10:
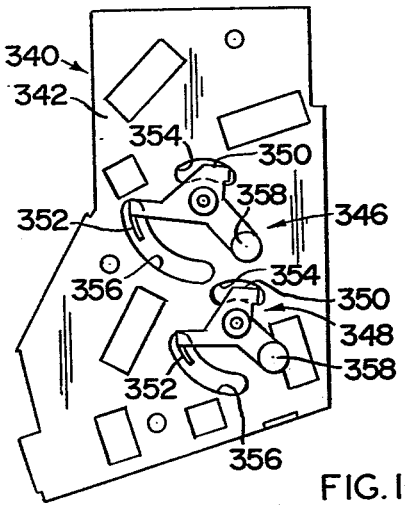
FIG. 10 is a left side view of the coin chute means mounting plate.

Coin control mechanism 52 also includes coin chute base plate 340 as shown in FIGS. 9 and 10. Coin chute base plate 340 comprises a substantially flat element 342 including a plurality of coin guides 344 arranged to normally extend through coin guide apertures 306 and 330 formed in first and second coin chutes 292 and 294, respectively such that coin guide 344 and coin chutes 292 and 294 cooperatively form a plurality of coin chutes as discussed more fully hereinafter. A plurality of coin control means comprising cradles 346 and 348 are pivotally attached to element 342. Each cradle comprises an upper and lower element 350 and 352 respectively, extending through upper and lower cradle slots 354 and 356 respectively. Elements 350 and 352 extend into coin chutes to engage the coins as more fully described hereinafter. Cradle 346 and 348 each include counter-weights 358 to control the coin passage in combination with the spacing of corresponding elements 350 and 352 relative to each other.

As shown in FIG. 13 coin controlled mechanism 52 is secured within coin mechanism housing 14 by passing studs 360 through apertures 82 formed in plate 54. Once studs 360 are passed through apertures 82, element 84 is pressed downward relative to plate 54 to operatively engage studs 360. In addition, the outer edge of plate 54 is secured between plates 362 and 364 and the front wall of coin mechanism housing 14.

The upper and lower prices are set by adjusting limit means 98 and 100 to set the selected limits of the total sum required to actuate the mechanism. This is accomplished by withdrawing the respective pins 113 from apertures 111 with tabs 102 and rotating limit means 98 and 100 to the appropriate aperture 111 as determined by the desired limits. Upon release of individual tabs 102, the respective pins 113 extend through their respective apertures 111 and remain in place under the influence of spring bias on shaft 109 between plate 70 and limit means 98 and 100. Since each aperture 111 represents an incremental value and limit means 98 and 100 are movable independent of each other, the difference between the upper and lower limits is variable.

With adjustment means adjusted, the price setter means, limit stop 280, is biased against the lower limit, lower stop notch 104, when control means 48 is in the first position or against the upper limit, upper stop notch 104, when control means 48 is in the second position. As shown in FIG. 14, with coin controlled mechanism 52 mounted in housing 14, latch member 66 operatively engages roller cam 118 forcing it upward to engage locking means 366 to lock access door 28. Simultaneously, dispenser actuator 218 is in engagement with totalizer operator means 272. In this configuration, coin controlled mechanism 52 is ready for operation.

As is similarly disclosed in U.S. Pat. No. 3,882,984, coins are inserted through slots 44 and 56 each is directed to coin passages A, B or C in accord with their size and weight. Quarters are directed through passage C through cradle means 346. As the quarter approaches actuator bar 242, it engages pins 244 and 246 causing bar 242 to move downward. The periphery of the quarter extends slightly below bar 242 to continue its full throw until pins engage the lower portion of slots 312. This is possible since the quarter engages control element 338 to rotate it out of the path of bar 242. With the down movement of actuator bar 242, member 238 moves upward advancing ratchet 268 and wheel 272 counterclockwise advancing notch portion 274 toward element 218 five increments. Locking means 262 engages teeth 270 to prevent further movement of ratchet 268 and wheel 272. The quarter is held in escrow hopper 368. Similarly, dimes and nickels are channeled through cradle 348 while the dime is permitted to fall directly through passage A. As the nickel passes through lower portion of passage means it engages limit means 318 rotating it into the path of pin 248 to limit the downward movement of bar 242 to advance wheel 272 one increment. As the dime passes through the lower portion of the passage means pin 246 engages control element 338 to limit the downward movement of bar 242 to advance wheel 272 two increments. As the totalizer is incremented to the preset coin price actuating combination in five cent increments when the proper amount is registered, door 22 may be opened by pulling it outward. When handle 30 is pulled outward, latch means 66 is biased upward as locking means 366 is moved outward. Roller cam 140 is permitted to move upward clockwise permitting locking means to move latch member 66 out of notch 370 (FIG. 14) permitting locking means to move latch member 66 out of operative alignment permitting opening of access door 22. As the upper portion of locking means 366 moves out of operative engagement with roller cam 118 latch member 66 is moved downward by bias means 114. Simultaneously, actuator 218 enters the cut out portion 274. As locking means 366 is moved further outward release tab 147 moves downward relative to arm 194 causing engagement with release actuator to move locking means 262 out of engagement with ratchet 268. Simultaneously, dispenser actuator 218 is moved out of notch 274 by dispensing reset 149. As locking means 366 is withdrawn, door 133 is biased open permitting the coins to be deposited into coin receptacle 94.

Figure 7:
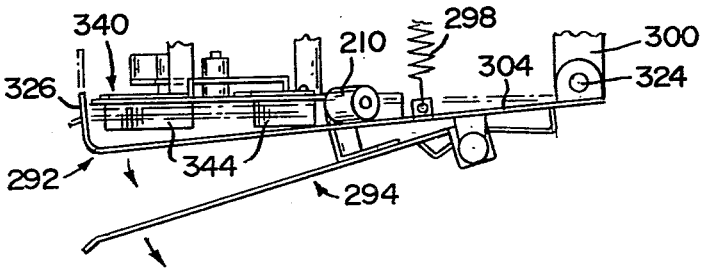
FIG. 7 is a top view of the coin chute means in the coin return position.

At any time coins may be returned by operating actuator 46. This simultaneously releases totalizer ratchet 268 by camming roller 200 engaging the outer end of release mechanism 212 and moving locking means 216. At the same time, camming roller 170 moves coin return means 158 to engage actuator 218 and moving coin return door 178 to the open position allowing coins to pass the coin return slot 62. An actuator 48 is depressed, bar 64 rotates moving roller cam 198 against surface 202 rotating separator arm 204. As shown in FIG. 7, as the coin chute is moved away from the base plate 340 roller cam 210 continues to act against camming surface 208 to continue the outward movement of second plate 292 separating coin chute plates 292 and 294 relative to each other to return any bent coins.

The anti-cheat mechanism prevents coins from being returned while at the same time the device is dispensing products. This is accomplished by member 224 which operatively engages the lower portion of bar 64 to prevent actuation of coin return by camming surface 232 when in the dispensing mode or move bar 64 over latch 66 to prevent upward movement thereof when in the coin return mode.

It will thus be seen that the objects set forth above, among those made apparent from the preceding description, are efficiently attained, and since certain changes may be made in carrying out the above method and article without departing from the scope of the invention, it is intended that all matter contained in the above description shall be interpreted as illustrative and not in a limiting sense.

It is also to be understood that the following claims are intended to cover all of the generic and specific features of the invention herein described and, all statements of the scope of the invention, which, as a matter of language, might be said to fall therebetween.

Now that the invention has been described.

What is claimed is:

1. A coin controlled mechanism for use with a dispensing machine wherein the dispensing machine includes an access door to permit removal of articles from the dispensing machine and latch means attached to the access door to normally lock the access door in a closed position, said controlled mechanism comprising a housing attached to the dispensing machine, coin chute means arranged within said housing to receive coins inserted into said housing, an actuator means movably attached to said housing and disposed to lockingly engage the latch means when in a non-dispensing position and disengage the latch means when in a dispensing position, a totalizer means movable between a dispensing and non-dispensing position disposed in coin interrupted disposition relative to said coin chute means to advance from said non-dispensing to said dispensing position in response to coins fed through said coin chute means, said actuator means movable from said non-dispensing to said dispensing position to operatively engage said totalizer means and disengage the latch means to unlock the access door when said totalizer means is in said dispensing position relative to said actuator means and an adjustable price setter means comprising a limit stop movable between an upper and lower limit disposed to engage said totalizer means to control the movement thereof and variable adjustment means mounted on said housing, said variable adjustment means including an upper and lower limit means movably mounted on said housing independent of each other to selectively vary the relative distance therebetween, said limit stop coupled to a price control means movable between a first and second position by a quick change adjustment means movable between a first and second position to move said limit stop between said upper and lower linits, said upper and lower limit means disposed to engage said limit stop to control said upper and lower limits.

2. The coin controlled mechanism of claim 1 wherein said upper and lower limit means each comprise an adjustment leg pivotally mounted on said housing and positionable in any one of a plurality of stop positions.

3. The coin controlled mechanism of claim 2 wherein each said adjustment leg includes a stop notch to engage said limit stop.

4. The coin controlled mechanism of claim 2 wherein said plurality of stop positions are defined by a plurality of apertures formed in said housing substantially adjacent the path of travel of said upper and lower limit means, said adjustment legs including a pin to rest in said apertures, each of said apertures in engageable relation with said adjustment legs, whereby said price setter means is manually adjustable.

5. The coin controlled mechanism of claim 1 wherein said totalizer means comprises a totalizer operator means including an enabling means movable between a dispensing and non-dispensing position disposed to selectively engage said actuator means to control movement of the access door and a bias means attached thereto to bias said totalizer operator means in the clockwise direction, said totalizer operator means including a limit plate formed thereon and said adjustable price setter means including a limit tab formed thereon, said limit tab disposed to operatively engage said limit plate to control the origin of rotation of said totalizer operator means relative to said actuator means, said actuator means disposed to operatively engage said enabling means and the latch means to unlock the access door when said totalizer operator means is in said dispensing position.

6. The coin controlled mechanism of claim 1 wherein said quick change adjustment means is coupled to said housing by a bias means to normally hold said limit stop at said lower limit when said price control means is in said first position.

* * * * *